US008671904B2

(12) United States Patent
D'Anna et al.

(10) Patent No.: US 8,671,904 B2
(45) Date of Patent: Mar. 18, 2014

(54) CYLINDER HEAD FOR AN INTERNAL COMBUSTION ENGINE, WITH INTEGRATED EXHAUST MANIFOLD AND SUBGROUPS OF EXHAUST CONDUITS MERGING INTO MANIFOLD PORTIONS WHICH ARE SUPERIMPOSED AND SPACED APART FROM EACH OTHER

(75) Inventors: Carmelo D'Anna, Turin (IT); Antonio Abozzi, Turin (IT)

(73) Assignee: Fiat Powertrain Technologies S.p.A., Turin (IT)

( * ) Notice: Subject to any disclaimer, the term of this patent is extended or adjusted under 35 U.S.C. 154(b) by 275 days.

(21) Appl. No.: 13/305,460

(22) Filed: Nov. 28, 2011

(65) Prior Publication Data

US 2012/0227686 A1 Sep. 13, 2012

(30) Foreign Application Priority Data

Mar. 10, 2011 (EP) ..... 11157678

(51) Int. Cl.
*F01N 3/02* (2006.01)

(52) U.S. Cl.
USPC ..... 123/193.5; 60/321; 60/323; 123/41.82 R

(58) Field of Classification Search
USPC ..... 123/193.5, 41.82 R; 60/323, 321
See application file for complete search history.

(56) References Cited

U.S. PATENT DOCUMENTS

| | | | | |
|---|---|---|---|---|
| 4,993,227 | A * | 2/1991 | Nagura et al. | 60/605.1 |
| 6,788,540 | B2 * | 9/2004 | Kruger et al. | 361/719 |
| 7,784,442 | B2 * | 8/2010 | Lester et al. | 123/193.5 |
| 7,849,683 | B2 * | 12/2010 | Asame et al. | 60/323 |
| 8,474,251 | B2 * | 7/2013 | Beyer et al. | 60/321 |
| 2008/0308050 | A1 * | 12/2008 | Kuhlbach et al. | 123/41.82 R |
| 2009/0241526 | A1 | 10/2009 | Son et al. | |
| 2010/0083920 | A1 | 4/2010 | Kuhlbach | |

FOREIGN PATENT DOCUMENTS

| | | | |
|---|---|---|---|
| DE | 2508952 | A1 | 10/1976 |
| EP | 2172635 | A1 | 4/2010 |
| JP | 2006083756 | A | 3/2006 |
| JP | 2006329128 | A | 12/2006 |
| JP | 2007285168 | A | 11/2007 |

OTHER PUBLICATIONS

European Search Report for corresponding European Application No. 11157678.1, dated Aug. 8, 2011.

* cited by examiner

*Primary Examiner* — M. McMahon
(74) *Attorney, Agent, or Firm* — Heslin Rothenberg Farley & Mesiti P.C.; Victor A. Cardona, Esq.

(57) ABSTRACT

A cylinder head for an internal combustion engine has a body integrating in a single cast piece, the exhaust manifold. The exhaust conduits form separate subgroups merging into manifold portions superimposed and spaced apart from each other. A lower cooling jacket, an upper cooling jacket and an intermediate cooling jacket are formed in the head. The lower cooling jacket is longitudinally divided into a plurality of separate transverse chambers, while the upper cooling jacket has a portion extended longitudinally over the entire development of the head. The lower cooling jacket has a portion extending in the area of the body which separates the superimposed portions of the subgroups of exhaust conduits. The intermediate jacket forms a main outlet at an end of the head. The upper jacket has a first portion at the center of the head and a second portion forming an auxiliary circuit adjacent to said main outlet.

1 Claim, 17 Drawing Sheets

CYLINDER HEAD FOR AN INTERNAL COMBUSTION ENGINE, WITH INTEGRATED EXHAUST MANIFOLD AND SUBGROUPS OF EXHAUST CONDUITS MERGING INTO MANIFOLD PORTIONS WHICH ARE SUPERIMPOSED AND SPACED APART FROM EACH OTHER

CROSS REFERENCE TO RELATED APPLICATIONS

This application claims priority to European Patent Application No. 11157678.1 filed Mar. 10, 2011, the entire disclosure of which is incorporated herein by reference.

FIELD OF THE INVENTION

The present invention refers to cylinder heads for internal combustion engines of the type having:

a body with an upper face, a lower face, two end faces and two lateral faces, said body integrating in a single cast piece, the engine exhaust manifold, said exhaust manifold being defined by a plurality of conduits for the exhaust gases provided in the body of the head and forming separate subgroups of exhaust conduits merging into manifold portions superimposed and spaced apart from each other which terminate on a lateral face of the head, a lower cooling jacket and an upper cooling jacket provided in the body of the head, substantially below and above conduits defining the exhaust manifold, and an intermediate cooling jacket interposed between the abovementioned manifold portions which are superimposed and spaced apart from each other, said intermediate jacket communicating with the lower and upper jackets through two interconnection conduits arranged adjacent to said lateral face, at the two sides of the outlet area of the exhaust manifold.

PRIOR ART

A cylinder head of the previously described type is for example illustrated in US2010/0083920 A1, equivalent to EP 2 172 635 A1. Cylinder heads with integrated exhaust manifold and superimposed exhaust manifold portions have been however known over time (DE-A-25 08 952). Cylinder heads of this type are also illustrated in JP 2006-083756, JP 2007-285168 and US 2009/0241526 A1.

The integration of the exhaust manifold in the cylinder head allows a construction simplification and also a reduction of the manufacturing costs, given that in the conventional engines with separate exhaust manifold the latter must be made of precious steel to bear the high operating temperatures, while in the cylinder heads with integrated manifold the material constituting the head and the manifold is typically aluminium, and the problem deriving from the high temperatures of the exhaust gases is resolved by providing a liquid cooling for the manifold and the head, through the abovementioned cooling jackets. The provision of an exhaust manifold integrated with manifold portions which are superimposed and spaced apart from each other allows advantages in terms of improved and more uniform cooling of the conduits also avoiding the gas dynamic interaction between the conduits.

In the abovementioned solution known from US2010/0083920 A1, the cylinder head has conduits provided parallel with respect to each other, to take the fluid coming from the cooling circuit of the engine block both directly to the abovementioned lower cooling jacket and directly to the abovementioned upper cooling jacket. The intermediate cooling jacket extends only in the central part of the head, on the exhaust side and communicates with the lower and upper jacket by means of the two interconnection conduits arranged at the two sides of the gas exhaust area. A drawback of the previously described prior art solutions lies in the fact that the lower and upper cooling jackets are substantially traversed each by a longitudinal flow of a cooling fluid, from one end of the head to the other, which does not guarantee an ideal and uniform cooling of all the portions of the head associated to engine cylinders. Furthermore the prior art solution provides for separate outlets for the abovementioned exhaust manifold portions.

OBJECT OF THE INVENTION

The object of the present invention is that of providing a cylinder head of the type indicated at the beginning of the present description where the abovementioned drawback is overcome and particularly where an optimal and uniform cooling of the portions of the head is guaranteed and in particular the cooling of the various portions of the exhaust manifold, associated to the various engine cylinders.

A further object of the invention is that of reducing the overheating to which the exhaust conduits associated to the engine cylinders are subjected to and the non-uniformities of such overheating between different exhaust conduits to the maximum.

SUMMARY OF THE INVENTION

With the aim of attaining such object, the invention aims at providing a cylinder head of the type indicated at the beginning of the present description and characterised in that:

said conduits of the exhaust manifold merge into a common outlet terminating on said lateral face of the head, the lower cooling jacket is longitudinally divided into a plurality of separate transverse chambers associated to various engine cylinders, and terminating in a longitudinal continuous portion of said lower jacket, extended along the exhaust side of the head, the intermediate cooling jacket is extended over the entire longitudinal extension of the head, it has conduits for communication with the abovementioned chambers of the lower jacket and an outlet at one end of the head, for the exit of the cooling fluid from the head, the upper cooling jacket has a first portion at the centre of the head, above the upper portion of the exhaust manifold, and a second portion extended longitudinally from said first portion up to said end of the head, where it forms an auxiliary outlet adjacent to said main outlet.

Due to the abovementioned characteristics, the head according to the invention ensures that the cooling fluid does not traverse the abovementioned lower cooling jacket longitudinally from one end of the head to the other, but it is at least partly forced to flow according to directions transverse to the longitudinal direction of the head, parallel in the various chambers associated to different engine cylinders, hence ensuring a correct translation velocity of the cooling fluid, as well as—above all—a substantial cooling uniformity between the various portions of the cylinder head, and in particular of the exhaust manifold, associated to various engine cylinders. The upper cooling jacket does not receive fluid directly from the engine block, but only from said chambers of the lower jacket as well as, through the abovementioned interconnection conduits, from the lower jacket and from the intermediate jacket. Furthermore, the latter is not limited to a central portion of the head, but it is extended over the entire longitudinal dimension of the head and forms the main outlet of the cooling fluid from the head.

BRIEF DESCRIPTION OF THE DRAWINGS

Further characteristics and advantages of the invention will be clear from the following description with reference to the attached drawings, provided purely by way of non-limiting example, wherein.

DETAILED DESCRIPTION OF A PREFERRED EMBODIMENT

Figure 1:
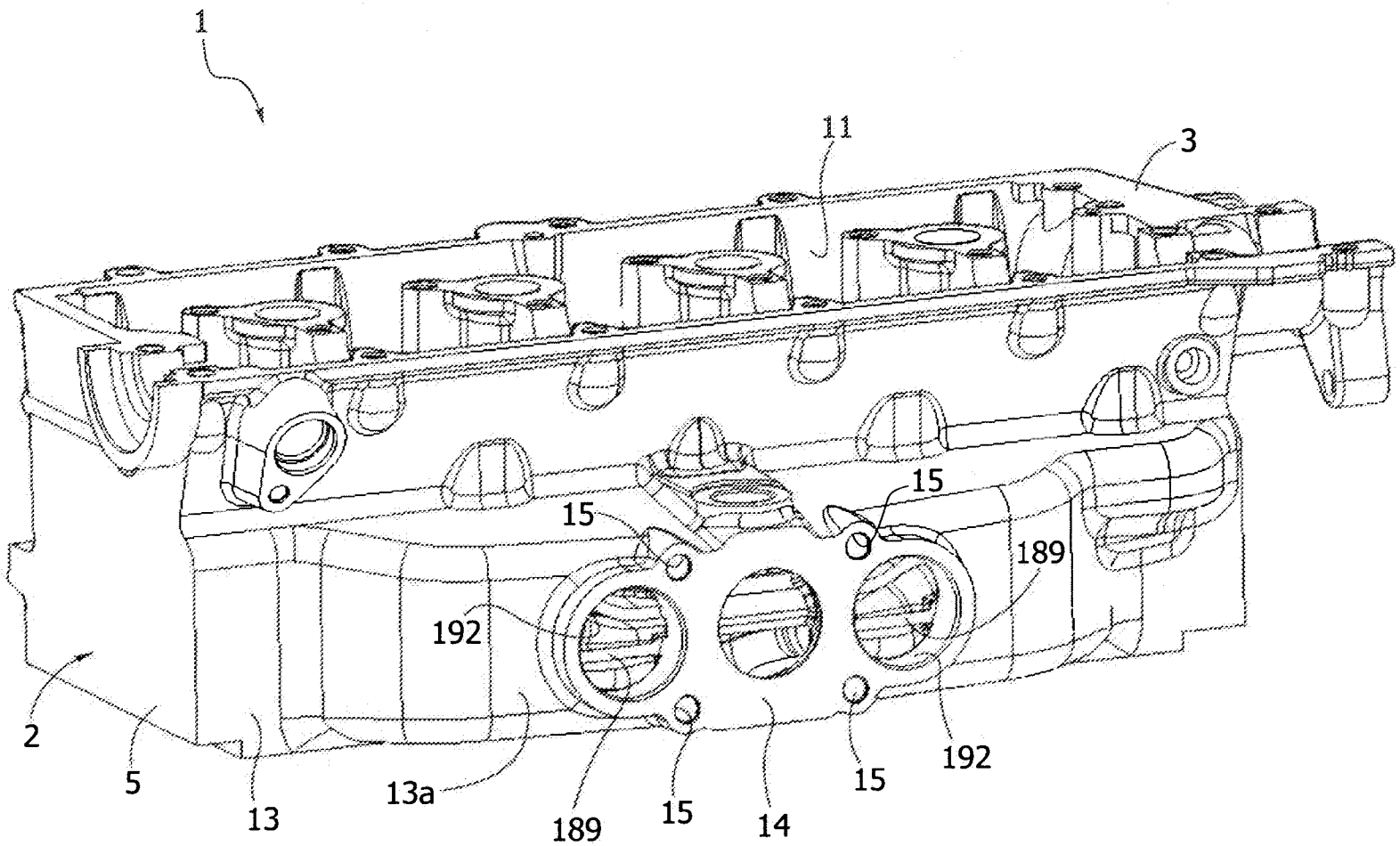
FIG. 1 is a perspective view of a cylinder head according to the invention.

The illustrated example refers to the case of the cylinder head of a turbocharged internal combustion engine, with four in-line cylinders. It is however clear that the present invention may be applied to any other type of engine, with any number of cylinders and both in cases where a turbo-supercharger unit is provided for and in cases where such unit is not provided for.

Referring to FIGS. 1-10, a cylinder head according to the invention, having a single aluminium body 2 with an upper face 3, a lower face 4 (see FIG. 2), a first end face 5 and a second end face 6 is indicated in its entirety with number 1.

Figure 10:
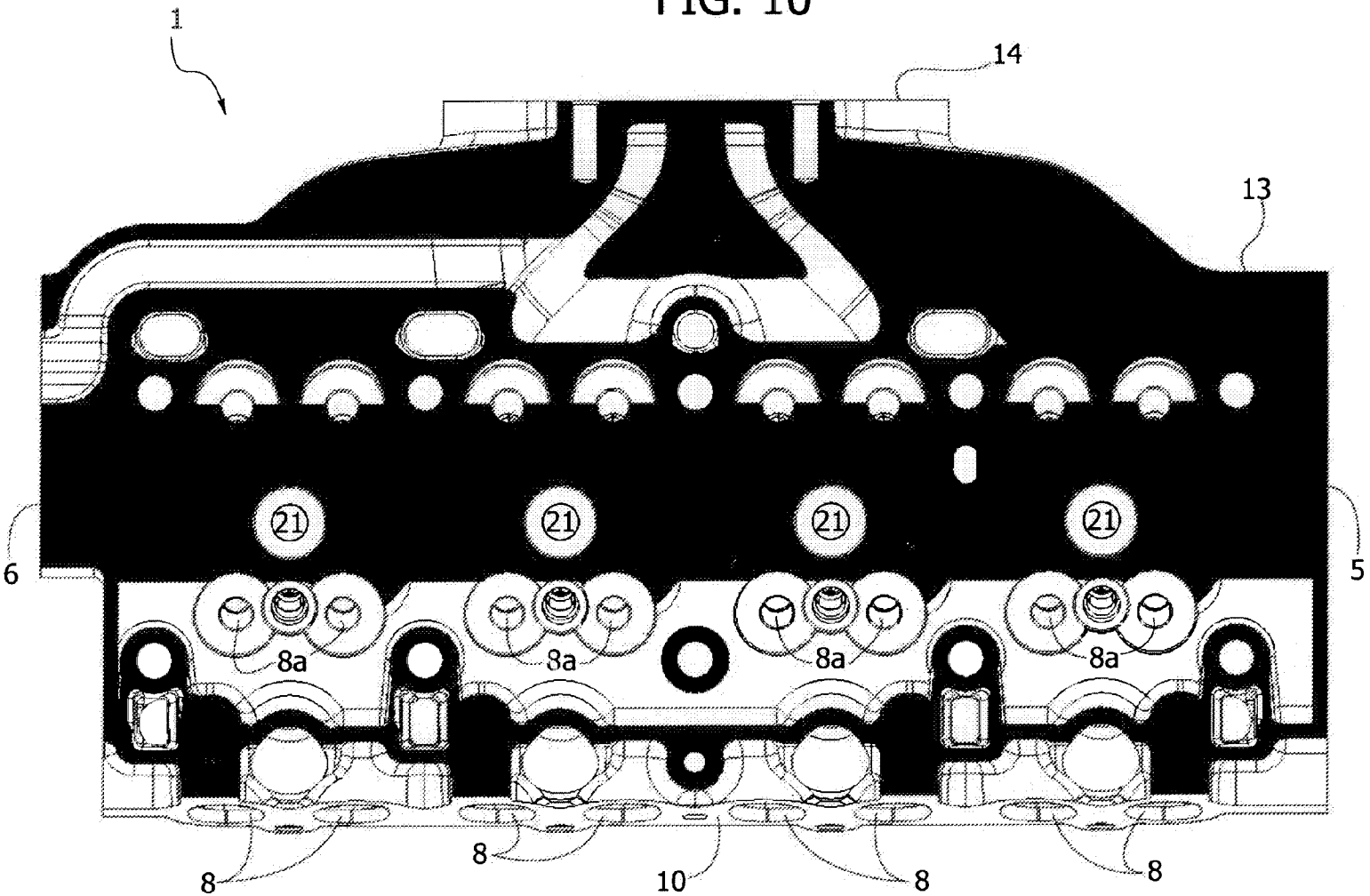
FIG. 10 is a sectional view according to line X-X of the FIG. 4.

Cavities 7 (see FIGS. 4, 5) defining the combustion chambers associated to engine cylinders are formed in the lower face 4 of the cylinder head. The illustrated example refers to the case of an engine provided with two intake valves and two exhaust valves for each engine cylinder. Therefore, two intake conduits 8 and two exhaust conduits 9 (see FIGS. 5,6) are formed by casting, for each engine cylinder, in the body 2 of the cylinder head 1. The intake conduits 8 terminate on a longitudinal side face 10 of the head (see FIGS. 3, 5, 6). FIGS. 5, 10 also show the through holes 8*a* and 9*a* terminating—at the upper part—on the upper face 3 of the head and—at the lower part—in the respective intake and exhaust conduits 8, 9, intended to receive and guide the stems of the intake and exhaust valves. A cavity 11 (FIGS. 1, 3) intended to house one or more camshafts and the respective tappets for the actuation of the intake and exhaust valves is provided in the upper face of the head according to the conventional art.

Figure 5:
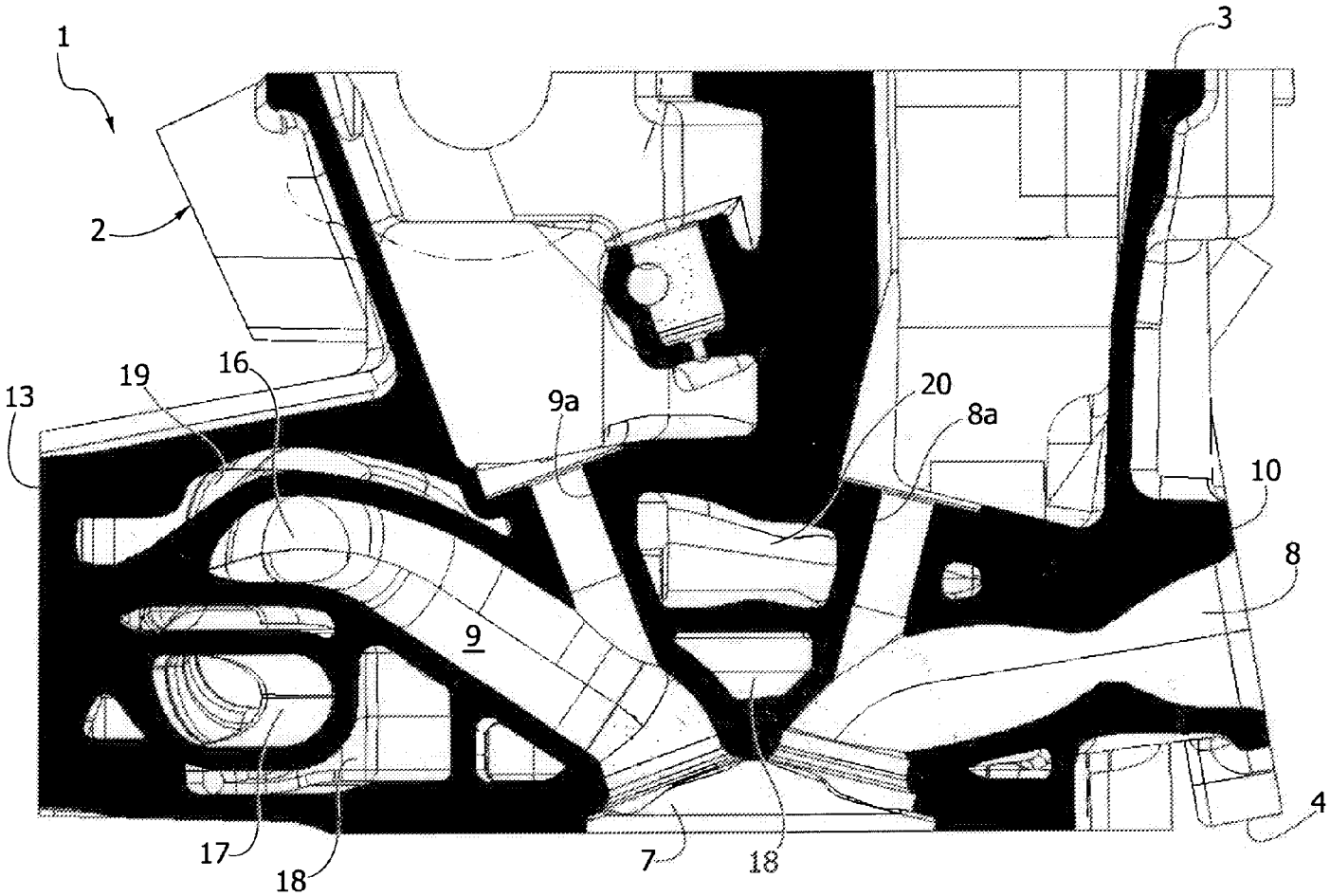
FIG. 5 is a sectional view according to line V-V of the FIG. 3.
Figure 6:
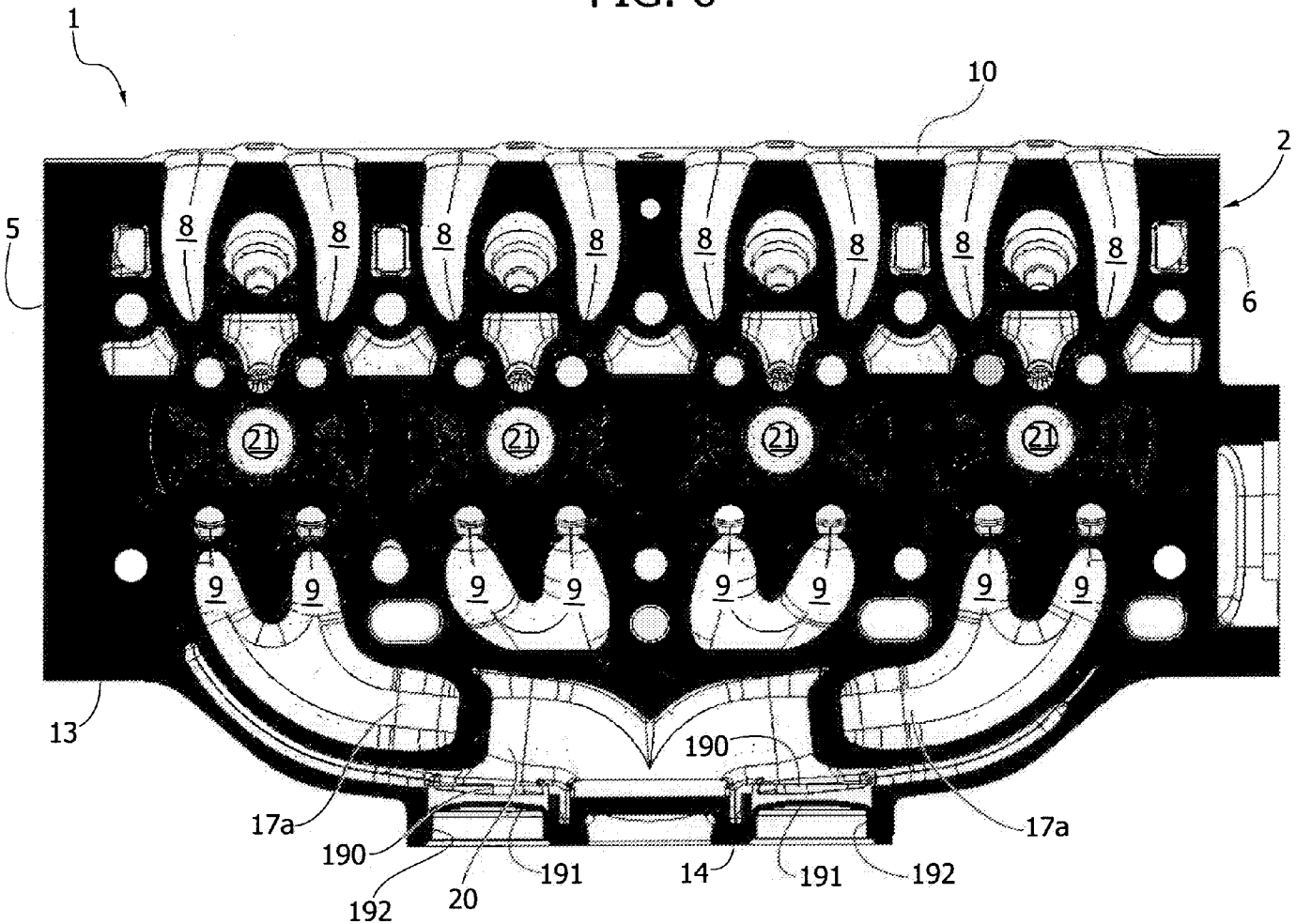
FIG. 6 is a sectional view according to line VI-VI of the FIG. 2.
Figure 7:
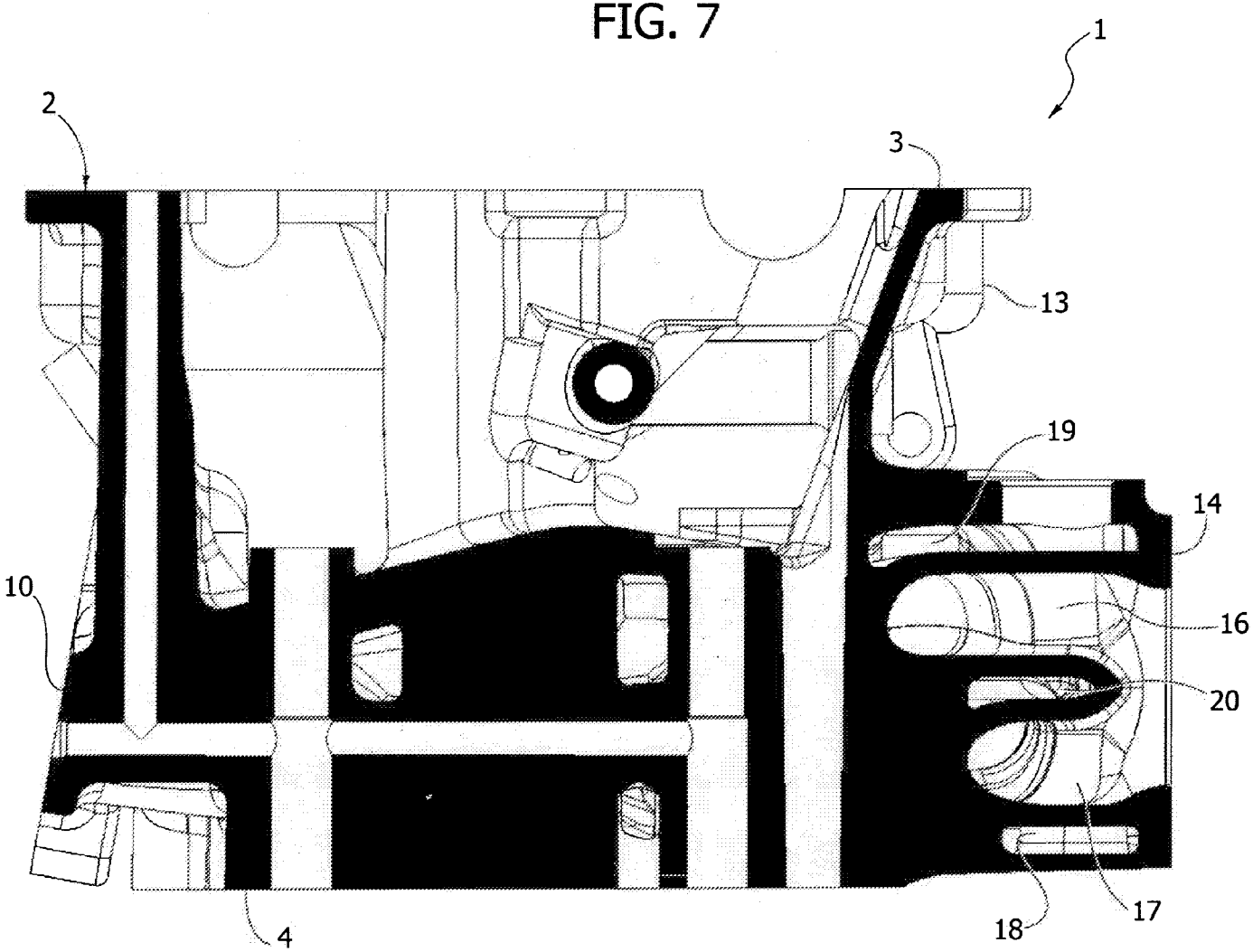
FIG. 7 is a sectional view according to line VII-VII of the FIG. 2.

As clearly observable in FIGS. 5, 6, 7, the engine exhaust manifold is also provided in a single cast piece in the cylinder head 1. The overall configuration of the conduits defining the exhaust manifold corresponds to that of the core used for obtaining them, observable in FIG. 13 of the attached drawings. In such figure, the parts of the sand core corresponding to the cavities obtained in the cylinder head are indicated with the same reference number.

Figure 13:
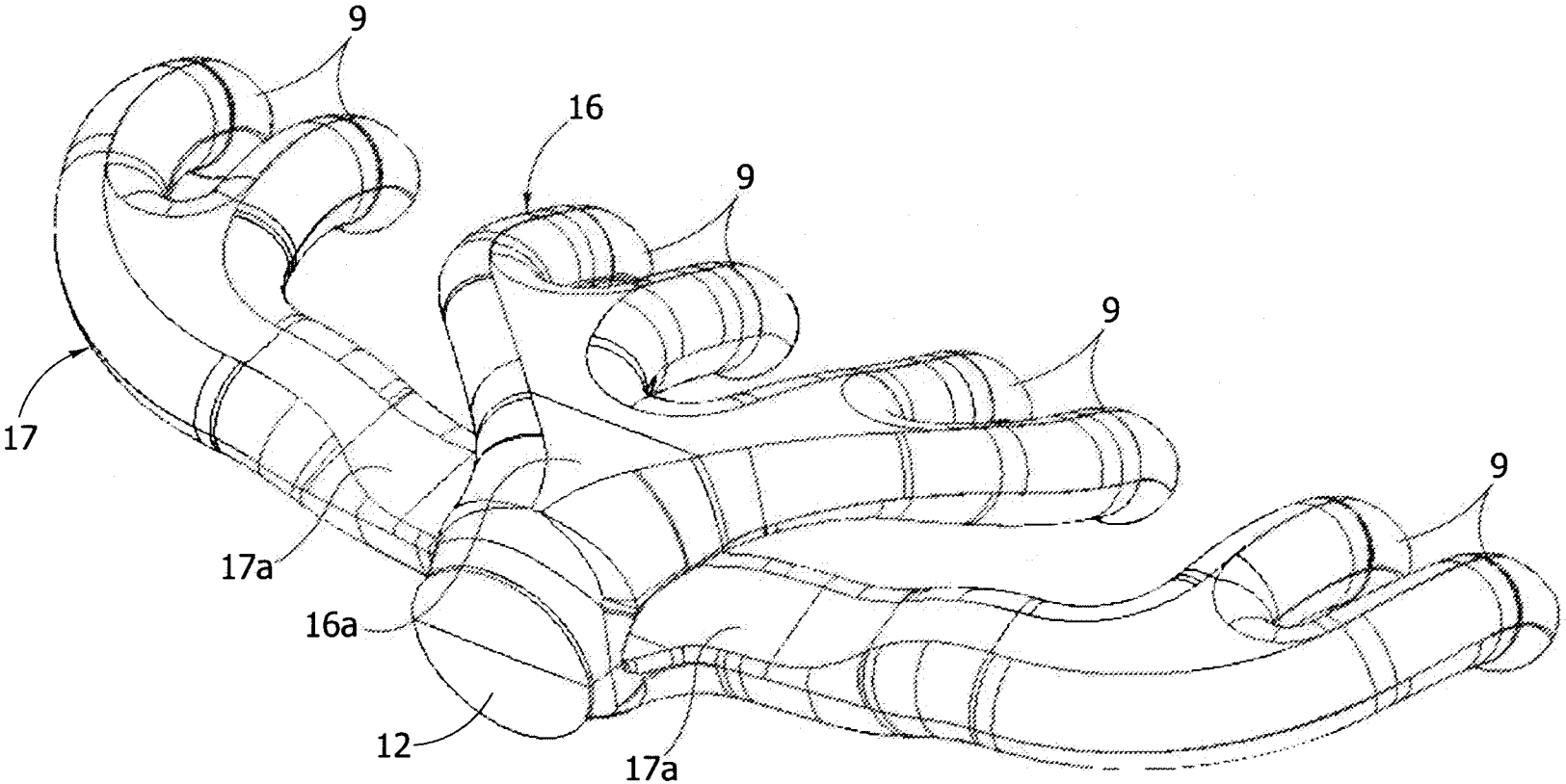
FIG. 13 is a perspective view, in assembled condition, of the two cores used for providing the exhaust conduits.

As observable in FIG. 13, all the exhaust conduits 9 merge into a common outlet 12 terminating on a longitudinal side face 13 of the cylinder head (FIG. 1) at a planar facet 14 bearing holes 15 for the engagement of screws for fastening the turbocharger unit (not illustrated). Returning to FIG. 13, the exhaust conduits 9 defining the exhaust manifold form two separate subgroups of exhaust conduits, respectively indicated with the reference numbers 16, 17. The subgroup 16 is constituted by the exhaust conduits 9 associated to the two engine cylinders which are at the centre of the aligned series of the four cylinders, while the subgroup 17 is constituted by the exhaust conduits 9 associated to the two cylinders which are at the ends of the series of cylinders. The exhaust conduits 9 of the first subgroup 16 mutually merge into a portion of manifold 16*a* which in turn merges at the outlet 12 with two conduits 17*a* part of the subgroup 17, into which the exhaust conduits 9 of each of the end cylinders merge. The conduits 17*a* extend in a direction substantially longitudinal with respect to the cylinder head, one towards the other, up to a central portion of manifold in which they merge together with the portion 16*a* within the common outlet 12.

As observable in FIG. 1, in the case of the illustrated example, the portion of the cylinder head in which the exhaust manifold is integrated defines a part 13*a* projecting from the longitudinal side face 13.

Figure 4:
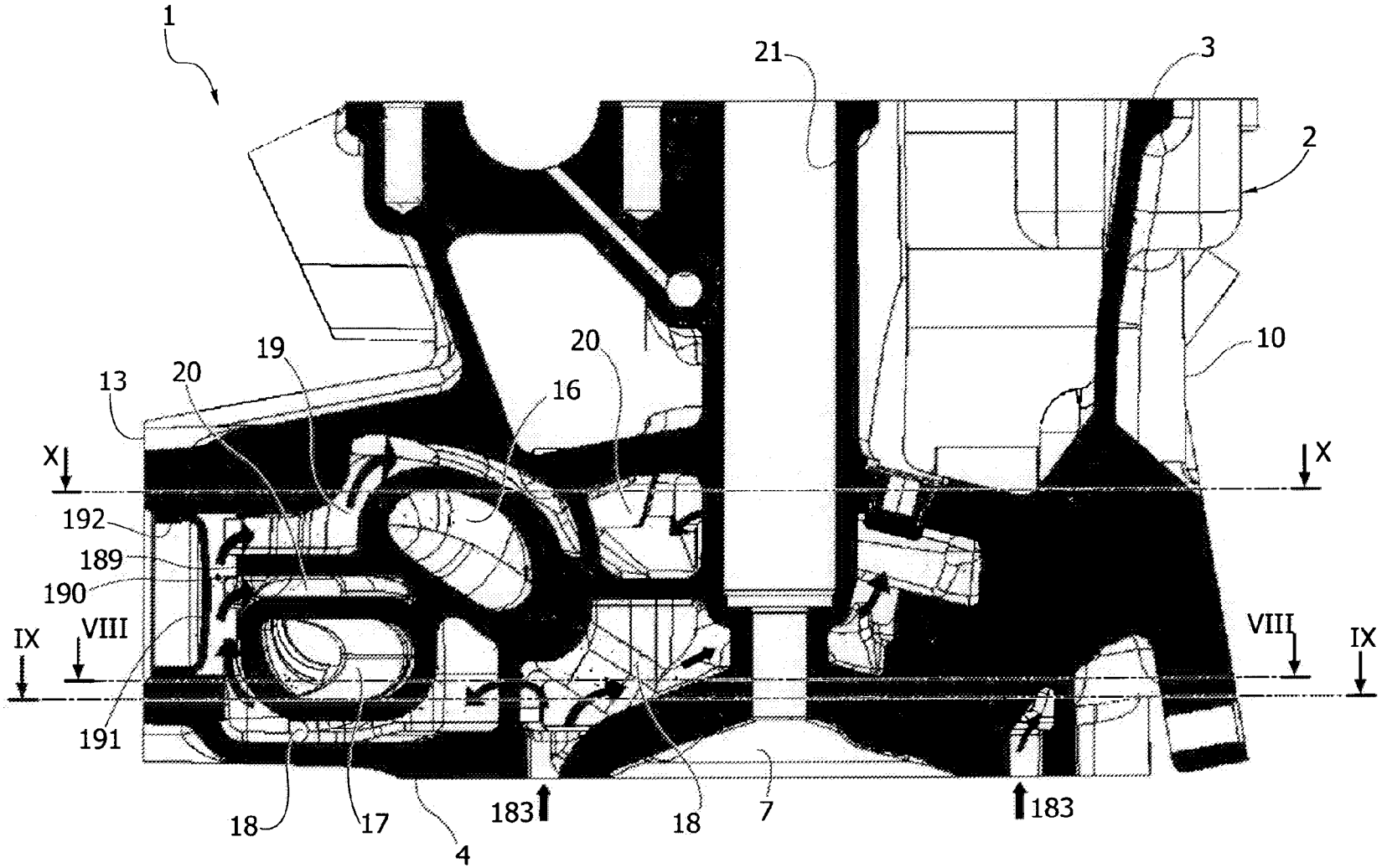
FIG. 4 is a sectional view according to line IV-IV of the FIG. 3.

With particular reference to FIGS. 4, 5, a lower cooling jacket 18, an upper cooling jacket 19 and an intermediate cooling jacket 20, for cooling the head and in particular the exhaust manifold provided in the head are also formed by casting in the body of the cylinder head 1. The lower and upper cooling jackets 18, 19 are extended substantially above and below conduits defining the exhaust manifold, as well as around the central common outlet 12. The intermediate jacket 20 extends between the central parts—which are superimposed and spaced apart from each other—of the subgroups of exhaust conduits 16, 17, extending from one part and from the other up to the opposite ends of the head. The configuration of the three jackets 18, 19, 20 is clearer from the observation of the configuration of the corresponding sand cores illustrated in FIGS. 11-17, where the parts of the cores were indicated using the same reference numbers which indicate the cavities of the head 1 corresponding thereto.

In the drawings, reference number 21 indicates the conduits provided in the cylinder head for mounting the spark plugs associated to various engine cylinders, while reference number 22 indicates further conduits provided in the head to allow mounting injectors associated to the various cylinders.

Figure 2:
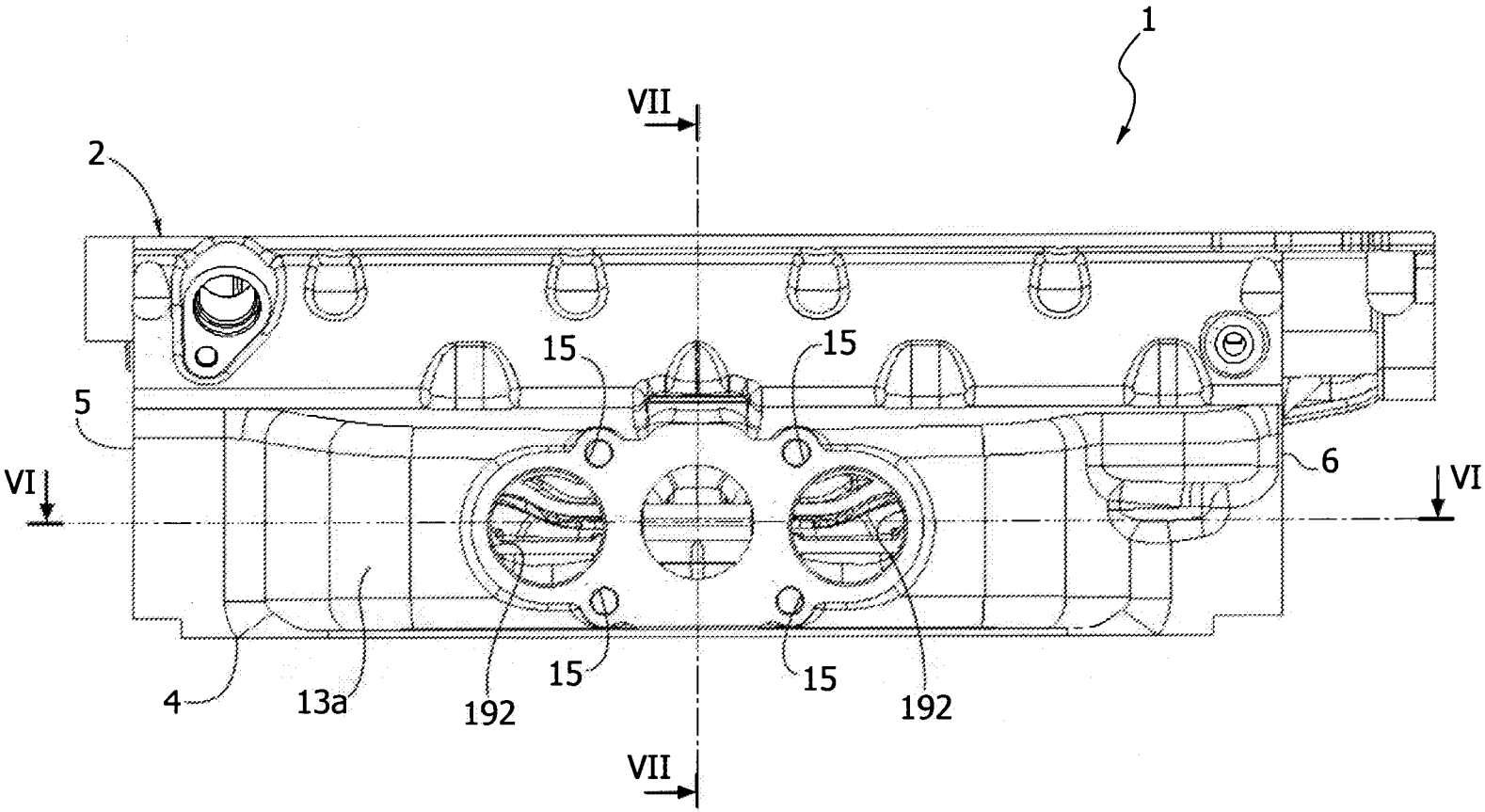
FIG. 2 is a side view of the cylinder head of the FIG. 1.
Figure 3:
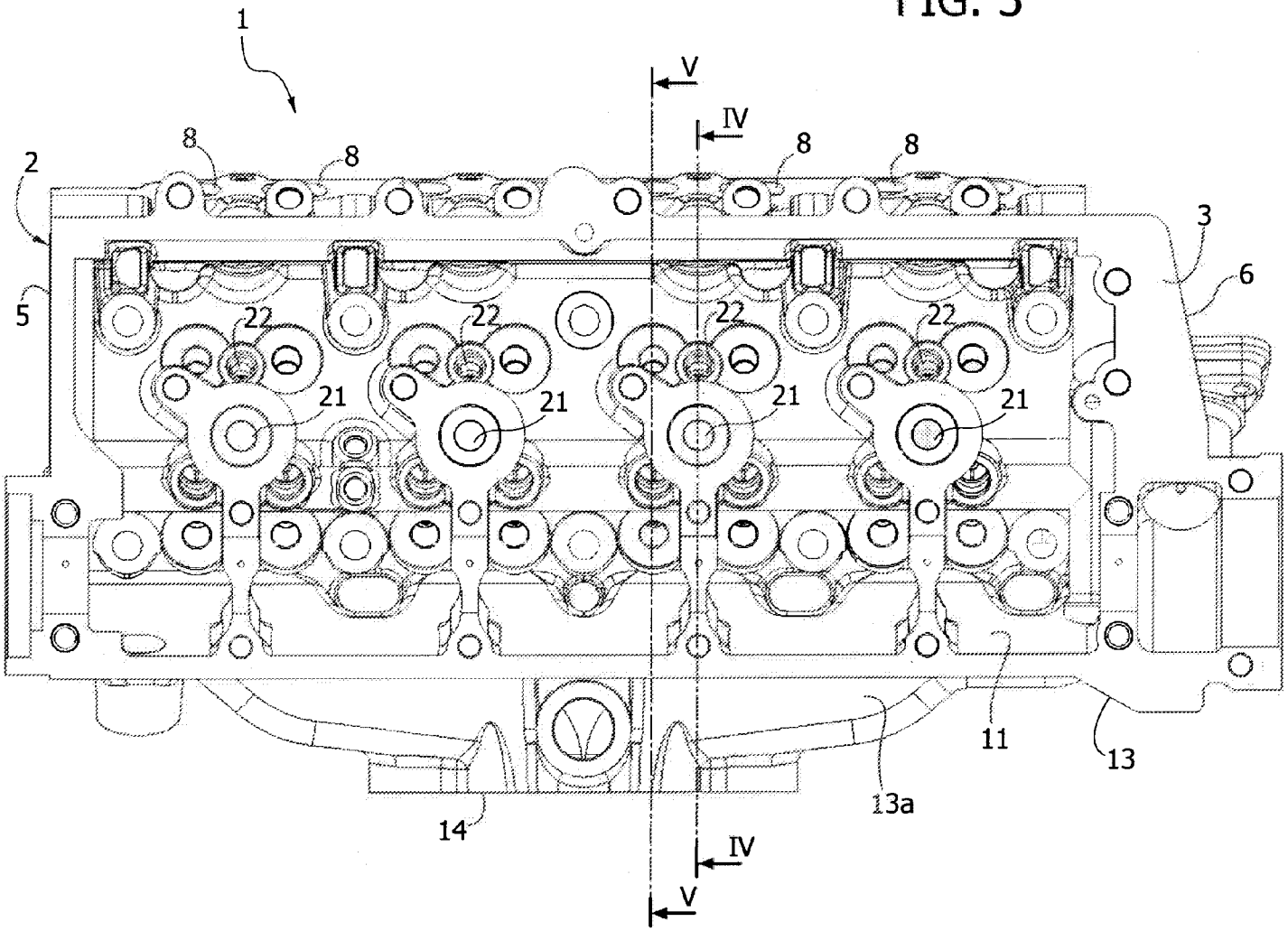
FIG. 3 is a plan view of the cylinder head of FIGS. 1, 2.
Figure 8:
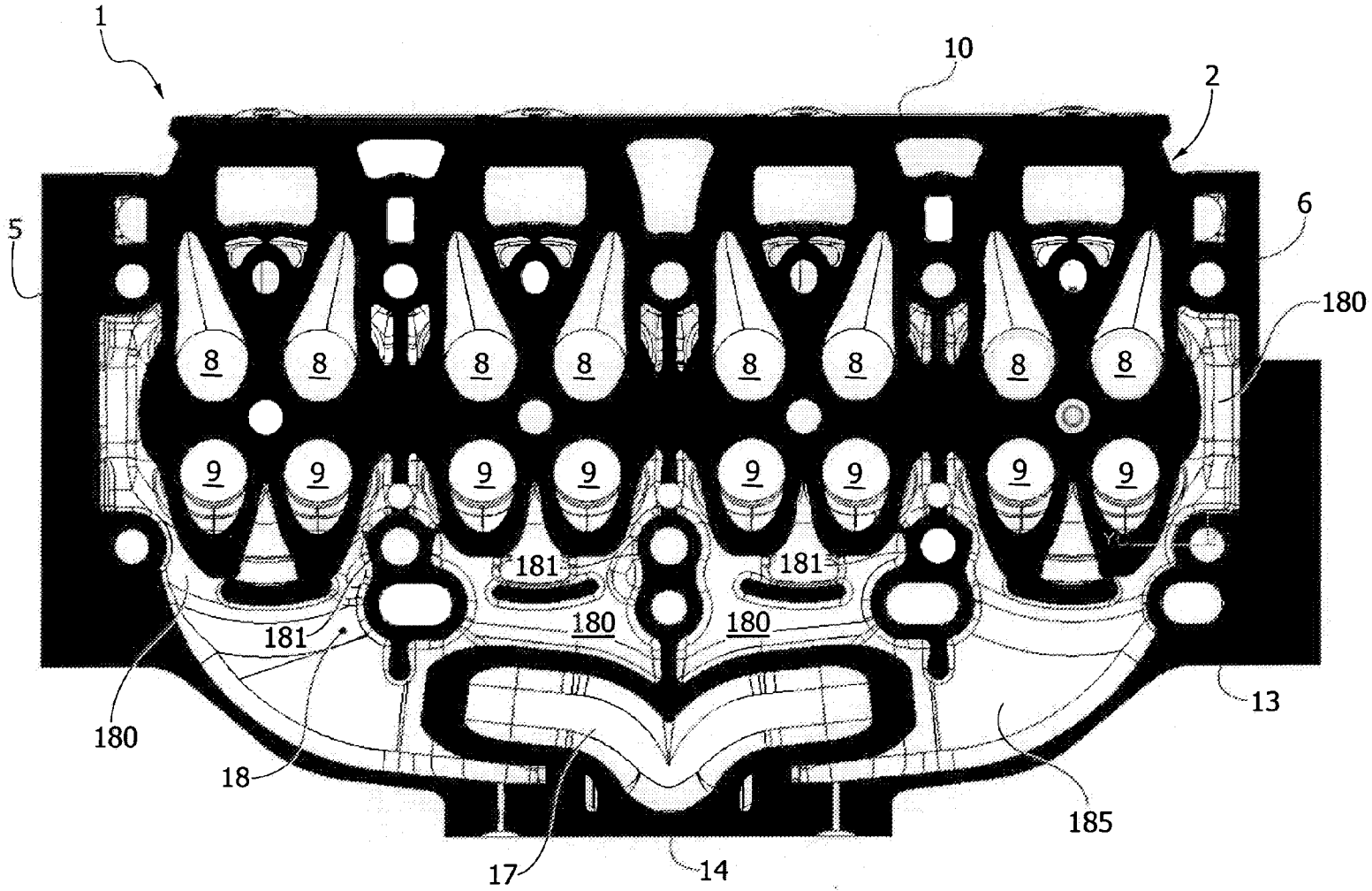
FIG. 8 is a sectional view according to line VIII-VIII of the FIG. 4.
Figure 9:
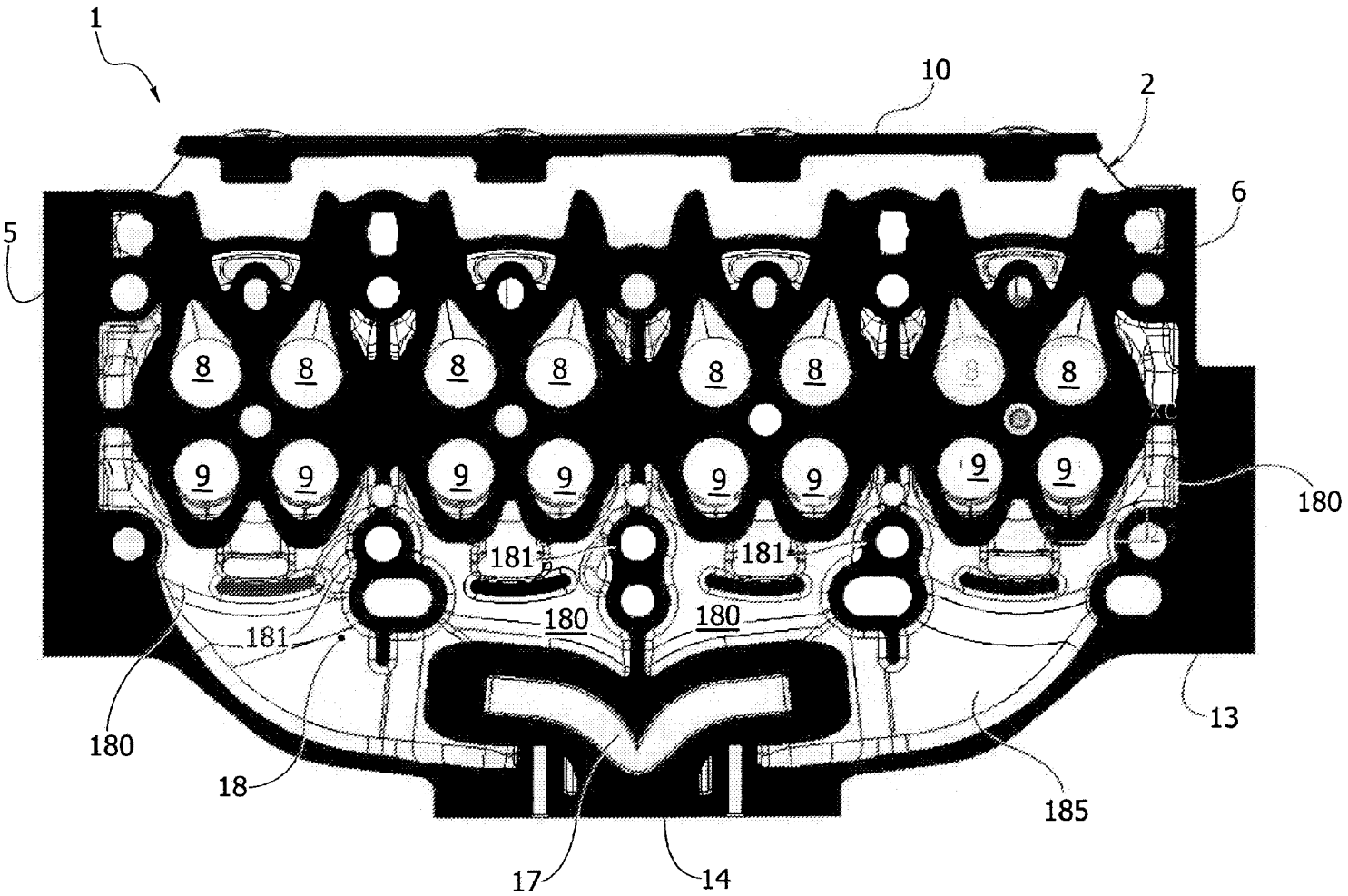
FIG. 9 is a sectional view according to line IX-IX of the FIG. 4.

FIGS. 8, 9 are sections according to lines VIII-VIII and IX-IX of FIG. 4, showing the lower cooling jacket 18. FIG. 6 is a section of the head in the horizontal plane corresponding to line VI-VI of FIG. 2, showing the intermediate cooling jacket 20. FIG. 10 is a section according to line X-X of the FIG. 4, showing the upper cooling jacket 19.

Figure 14:
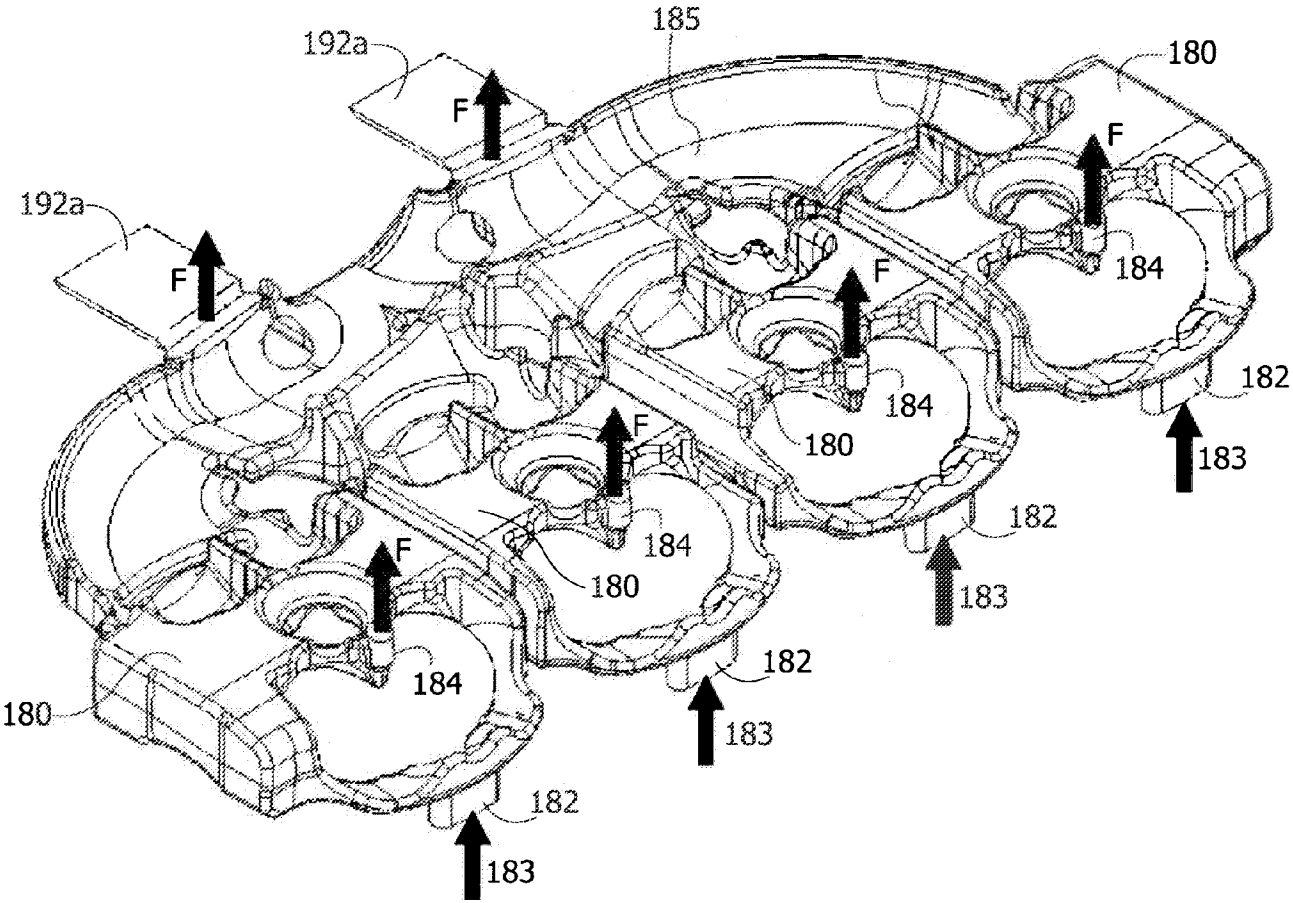
FIGS. 14, 15, 16 are perspective views specifically illustrating the cores used for the lower cooling jacket, for the intermediate cooling jacket and for the upper cooling jacket.

Referring to FIGS. 8, 9, as well as FIG. 14, it is clearly observable that the lower cooling jacket 18 is longitudinally divided into four transverse chambers 180 associated to four engine cylinders, by means of transverse partitions 181 provided in a single piece with the cylinder head. The transverse chambers 180 of the lower cooling jacket 18 are intended to receive cooling fluid from the circuit provided in the engine block by means of conduits 182 distributed over the entire length of the cylinder head and provided starting from the lower face of the head respectively adjacent to the intake side and the exhaust side of the combustion chambers 7. FIG. 14 shows appendages 182 of the sand core used for obtain some of the abovementioned communication conduits which allow the arrival—in the separate transverse chambers 180 of the lower cooling jacket 18—of cooling liquid coming from the circuit provided in the engine block, according to the arrows indicated with 183 in FIGS. 4 and 14.

The chambers 180 terminate in a longitudinal continuous portion 185 of said lower jacket 18, extended along the exhaust side of the head (also see FIG. 14).

Due to the previously described arrangement, the cooling liquid coming from the engine block is forced to pass through the lower cooling jacket 18 traversing—parallel—the four transverse chambers 180, according to directions orthogonal to the longitudinal direction of the head. Thus, the cooling liquid which passes through the transverse chambers 180 reaches the exhaust side of the cylinder head cooling the walls of the subgroup 17 of exhaust conduits passing below of such subgroup.

The cooling liquid passes from the lower cooling jacket 18 to the upper cooling jacket 19 both by means of conduits 184 (FIG. 14) arranged adjacent to the combustion chambers and by means of a pair of conduits 190 (FIG. 4) defined by closing elements 191 which obstruct two cylindrical cavities 192 terminating on the face 13 of the cylinder head at the two sides of the central outlet 12 for the exhaust gases (see FIGS. 1, 4, 6, 14, 15). In FIGS. 1, 2, the closing elements 191 were omitted, so the edge of a partition 189 (FIG. 4) which separates the lower and intermediate cooling jackets 18, 20 can be observed. As clearly observable in FIG. 4, the closing element 191 is spaced from the front edge of the partition 189, so as to define the communication conduit 190.

As clearly observable in FIG. 4, each of the conduits 190 thus defined places in communication not only the lower jacket 18 with the intermediate jacket 20, but also both jackets 18 and 20 with the upper jacket 19. Each conduit 190 is therefore a conduit for interconnection between the three jackets.

Figure 11:
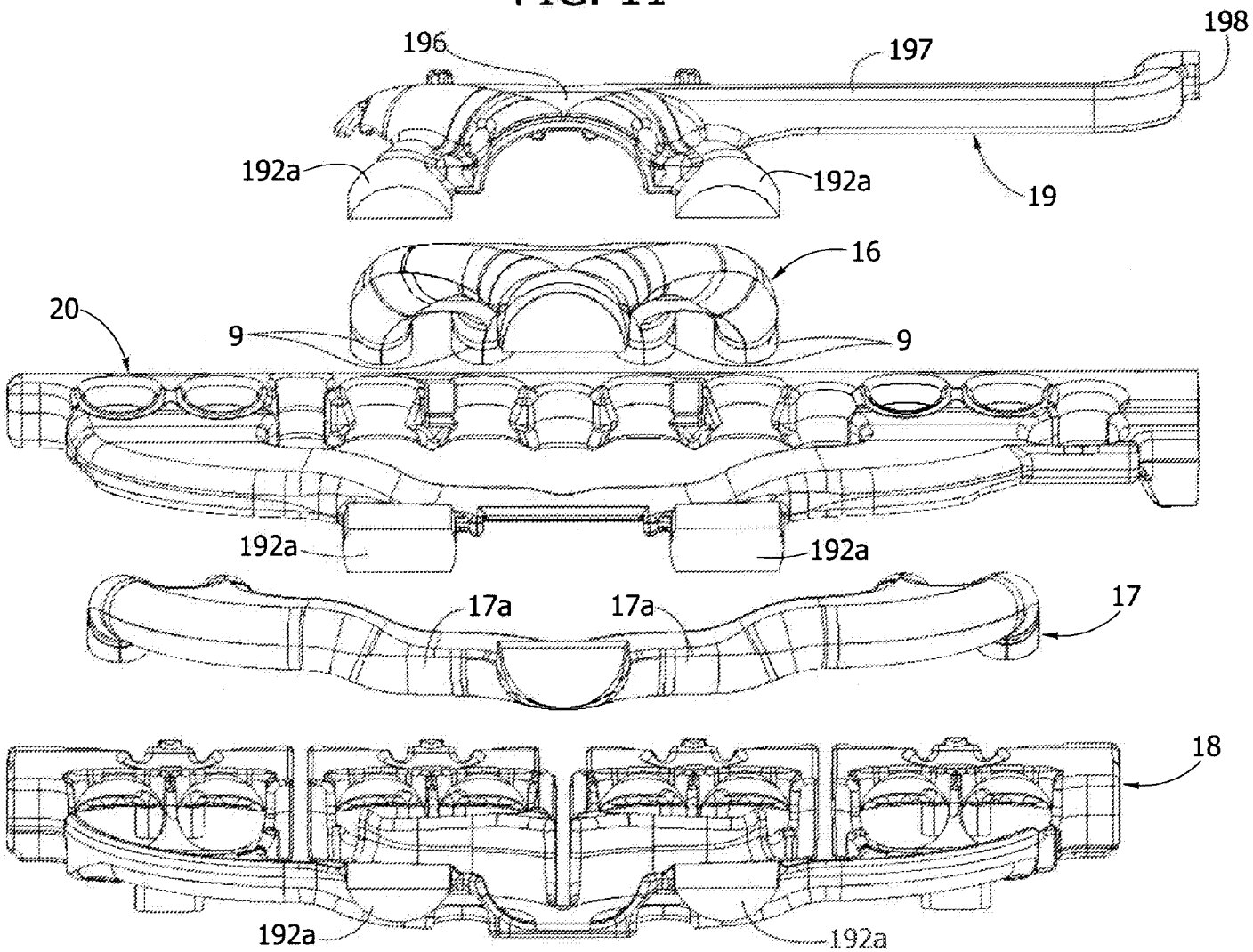
FIG. 11 is an exploded perspective view of the sand cores used for providing the exhaust conduits and the three cooling jackets in the body of the cylinder head according to the invention.
Figure 12:
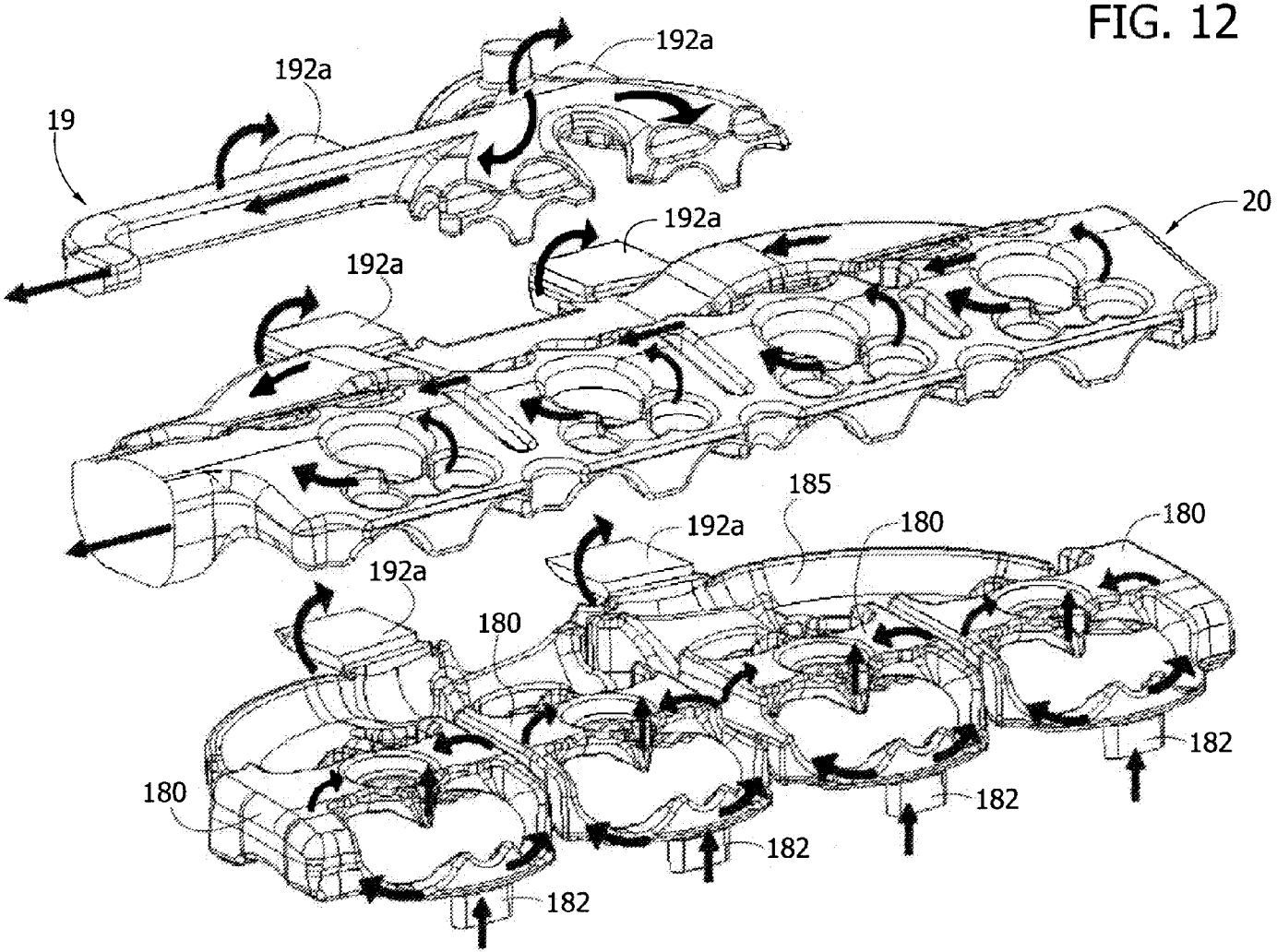
FIG. 12 is an exploded perspective view of the sand cores used for providing the three cooling jackets.

In FIGS. 11 and 12, reference number 18 indicates—in its entirety—the sand core intended to define the lower cooling jacket 18 of the cylinder head according to the invention, while reference numbers 19, 20 indicate the sand cores intended to define the upper cooling jacket 19 and the intermediate cooling jacket 20. The cylindrical cavities defined by the abovementioned tubular appendages 192 are obtained as a result of the cooperation between appendages 192*a* of the three cores.

Due to such arrangement, in the cylinder head according to the invention the cooling liquid coming from the lower cooling jacket 18 arrives in the upper cooling jacket 19 through the abovementioned conduits 190, and through the conduits 184, which respectively communicate with the separate chambers 180 of the lower jacket 18. The cooling liquid exits from the lower jacket 18 in the direction of the arrows F of FIG. 14 and enters into the intermediate jacket 20, as well as, through the conduits 190, also directly in the upper jacket 19.

Figure 15:
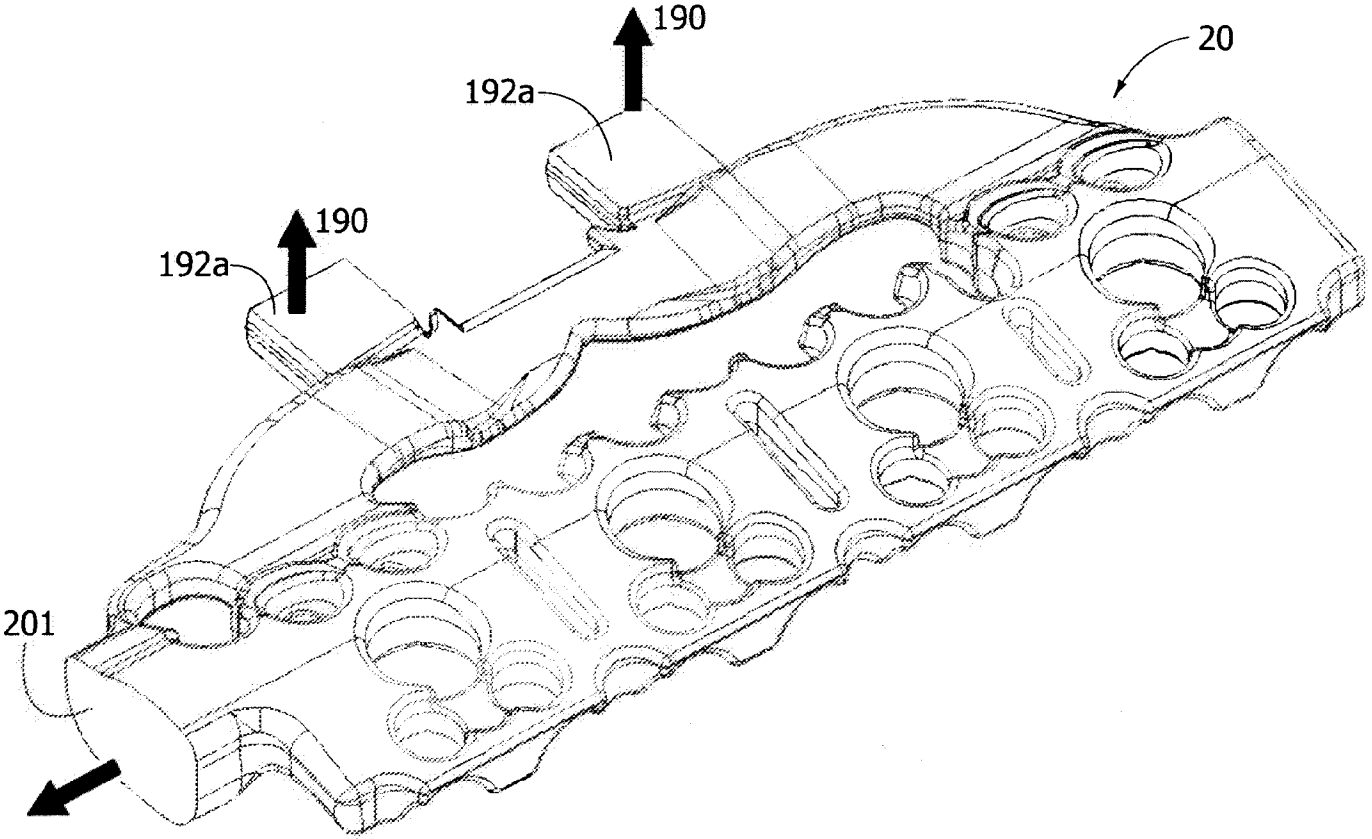

Referring to FIG. 15, the intermediate jacket 20 extends longitudinally over the entire head and terminates in a main outlet 201 at an end of the head, through which the cooling liquid which has passed through the lower jacket 18 and the intermediate jacket 20 exits from the head.

Figure 16:
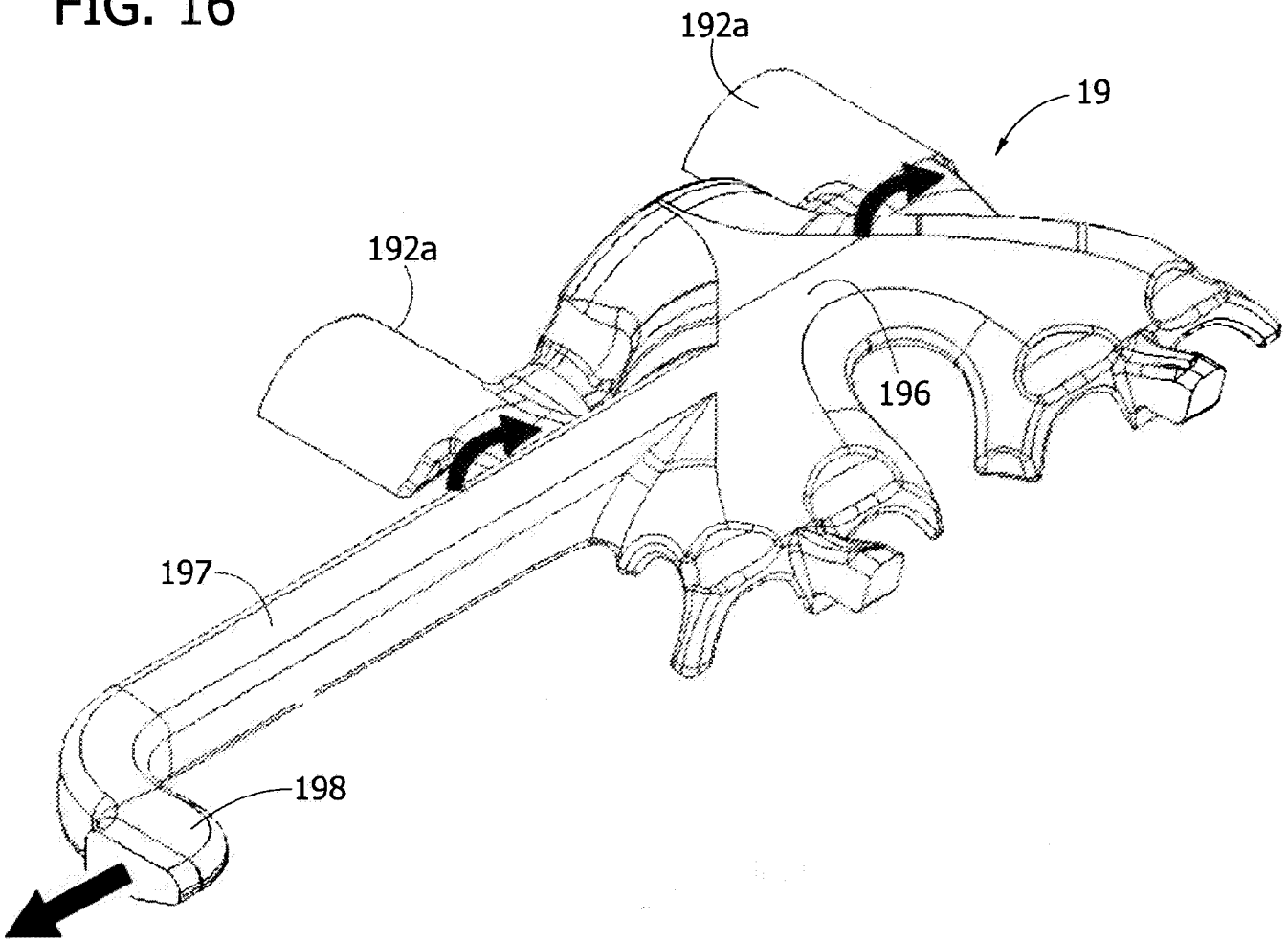
Figure 17:
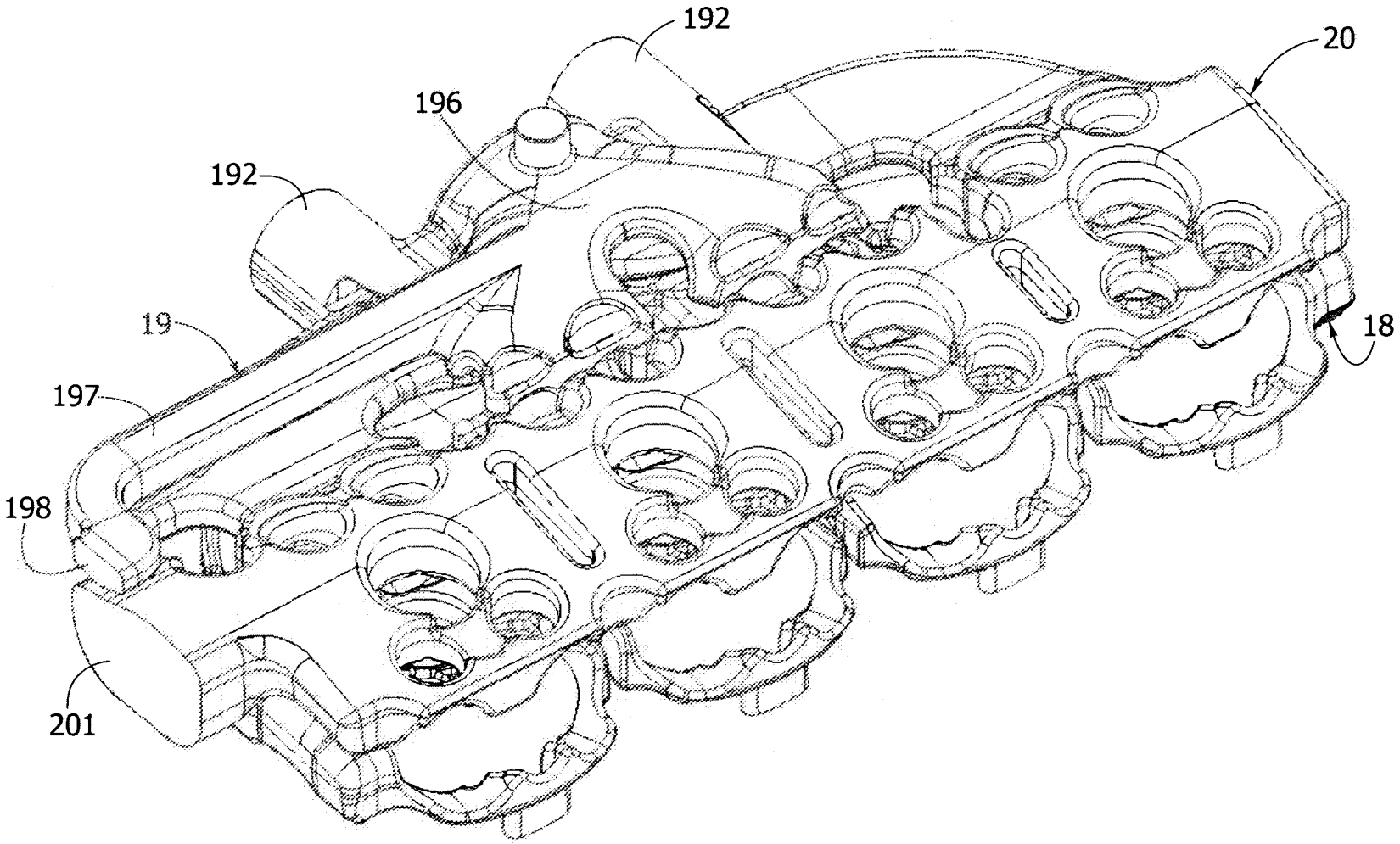
FIG. 17 illustrates a further perspective view of the cores of FIGS. 14, 15, 16, in assembled condition.

Referring to FIG. 16, the upper cooling jacket 19 has a first portion 196 at the centre of the head, above the upper portion 16 of the exhaust manifold, and a second portion 197 extended longitudinally from said first portion 196 up to an end of the head where it forms an auxiliary circuit 198 adjacent to the main outlet 201. The first portion 196 includes a bridge part surrounding—at the upper part—the outlet area of the gas. The portion 197 defines a channel useful for allowing the release of possible air bubbles which accumulate in the part upper of the jacket 19.

As clear from the description above, the cylinder head according to the invention has the exhaust manifold integrated therein and comprises separate subgroups 16, 17 of exhaust conduits merging into manifold portions which are superimposed and spaced apart from each other. Furthermore, a lower cooling jacket which receives cooling liquid from the engine block through a plurality of openings distributed over the entire longitudinal dimension of the head is provided for so as to supply the cooling liquid to a plurality of separate transverse chambers 180 which are passed through—parallel—by the cooling liquid, transversely to the longitudinal direction of the head. The cooling liquid thus passes from the lower cooling jacket to the upper and intermediate cooling jackets. The latter are passed through both transversely and longitudinally, up to the exit of the cooling liquid at the outlets 201 and 198 at an end of the cylinder head.

The cylinder head according to the invention allows, due to the abovementioned characteristics, combining the advantages of an exhaust manifold formed by superimposed and spaced subgroups of exhaust conduits, with the advantages in terms of more efficient cooling deriving from the specific configuration and arrangement of the cooling jackets. Simultaneously, the cylinder head according to the invention can be obtained in a relatively simple manner and at relatively low costs by providing the cores configured as described above.

Obviously, without prejudice to the principle of the invention, the construction details and embodiments may widely vary with respect to what has been described and illustrated purely by way of example, without departing from the scope of protection of the present invention.

What is claimed is:

1. Cylinder head for an internal combustion engine having:

a body with an upper face, a lower face, two end faces and two lateral faces, said body integrating in a single cast piece, the engine exhaust manifold, said exhaust manifold being defined by a plurality of conduits for the exhaust gases provided in the body of the head and forming separate subgroups of exhaust conduits merging into manifold portions superimposed and spaced apart from each other which terminate on a lateral face of the head, said conduits of the exhaust manifold merge into a common outlet terminating on said lateral face of the head, a lower cooling jacket and an upper cooling jacket provided in the body of the head, substantially below and above conduits defining the exhaust manifold, and an intermediate cooling jacket interposed between the abovementioned manifold portions which are superimposed and spaced apart from each other, said intermediate jacket communicating with the lower and upper jackets through two interconnection conduits arranged adjacent to said lateral face, at the two sides of the outlet area of the exhaust manifold;

the lower cooling jacket is longitudinally divided into a plurality of separate transverse chambers associated to various engine cylinders, and terminating in a longitudinal continuous portion of said lower jacket, extended along the exhaust side of the head, the intermediate cooling jacket is extended over the entire longitudinal extent of the head, the intermediate cooling jacket has conduits for communication with the above-mentioned chambers of the lower jacket and a cooling fluid outlet at one end of the head, for the exit of the cooling fluid from the head, the upper cooling jacket has a first portion at the center of the head, above the upper portion of the exhaust manifold, and a second portion extended longitudinally from said first portion up to said end of the head, where said second portion forms an auxiliary circuit adjacent to said cooling fluid outlet.

* * * * *